United States Patent [19]

Krapf

[11] Patent Number: 4,967,052

[45] Date of Patent: Oct. 30, 1990

[54] MICROWAVE HEAT PIPE HEATING SYSTEM

[76] Inventor: Edward J. Krapf, 79 Middle St., Locust Dale, Pa. 17945

[21] Appl. No.: 525,613

[22] Filed: May 21, 1990

[51] Int. Cl.[5] ..... H05B 6/80

[52] U.S. Cl. ..... 219/10.55 R; 219/10.55 A; 392/456; 165/104.19

[58] Field of Search ..... 219/10.55 R, 10.55 A, 219/10.55 F, 325, 326, 378; 165/104.19, 104.23, 104.24, 104.11

[56] References Cited

U.S. PATENT DOCUMENTS

| | | | |
|---|---|---|---|
| 3,816,689 | 6/1974 | Long | 219/10.55 A |
| 3,854,454 | 12/1974 | Lazaridis | 219/326 |
| 3,891,817 | 6/1975 | Brown | 219/10.55 R |
| 4,114,011 | 9/1978 | Stubbs | 219/10.55 A |
| 4,131,785 | 12/1978 | Shutt | 219/326 |

*Primary Examiner*—Philip H. Leung

[57] ABSTRACT

A microwave heat pipe heating system is provided and consists of at least one sealed heat pipe having self contained water therein. The heat pipe extends from a microwave containment enclosure into a domestic hot water tank. The self contained water heated by microwave beams will cause the sealed heat pipe extending into the domestic hot water tank to heat water therein for use in a normal water circulation system. In an alternate embodiment a microwave permeable pipe extends through two opposite walls of a microwave containment enclosure for conveying water capable of being heating by microwave beams. The pipe is divided into smaller pipes after entering through one of the walls and reconvening before exiting through other of the walls of the microwave containment enclosure to expose more water surface area to the microwave beams to enhance the heating efficiency of the microwave beams.

2 Claims, 2 Drawing Sheets

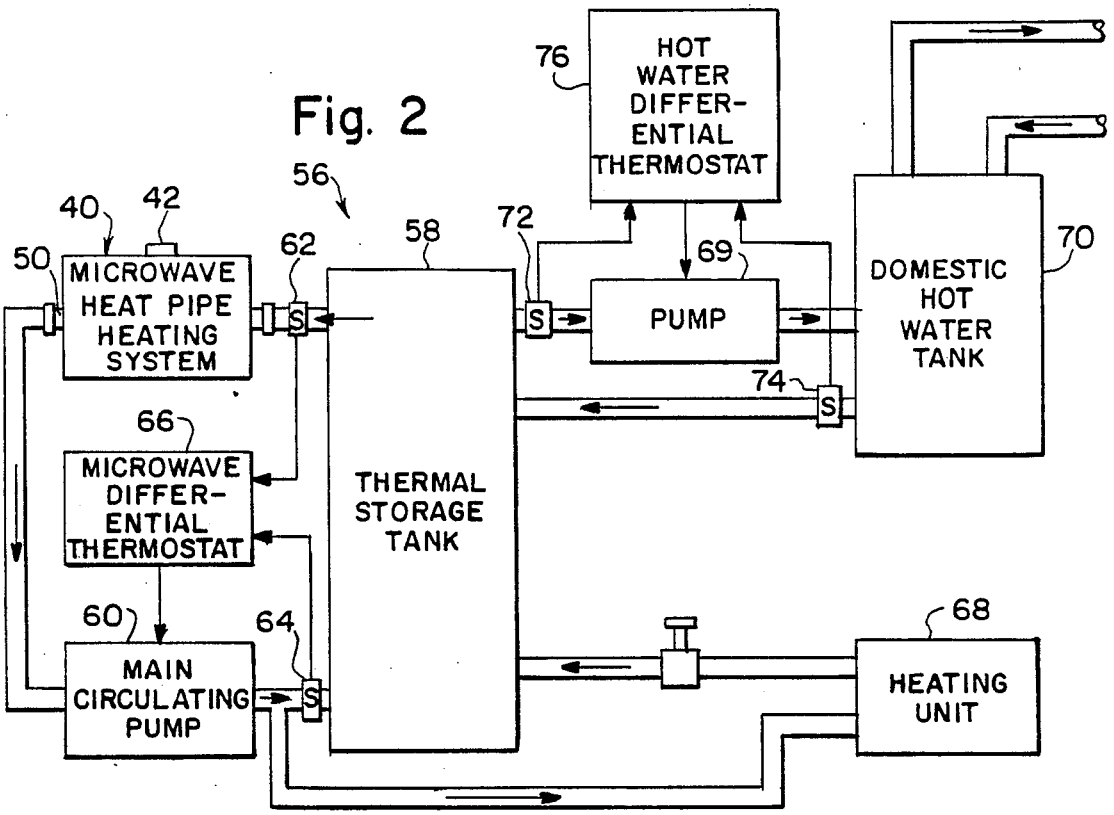
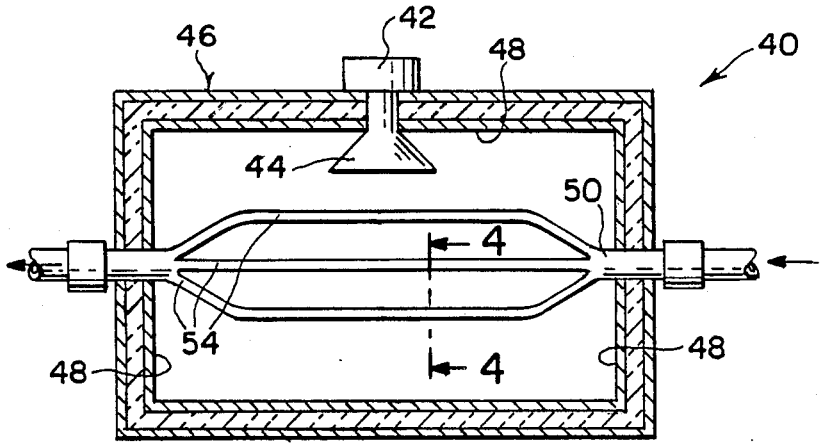
Fig. 3
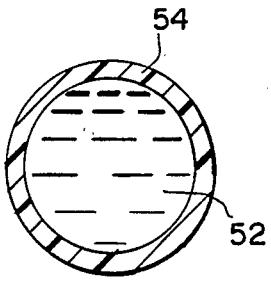
Fig. 4

MICROWAVE HEAT PIPE HEATING SYSTEM

BACKGROUND OF THE INVENTION

1. Field of the Invention

The instant invention relates generally to microwave water heaters and more specifically is relates to a microwave heat pipe heating system.

2. Description of the Prior Art

Numerous microwave water heaters have been provided in prior art that are adapted to heat water by utilizing electromagnetic energy confined within a resonant cavity. For example, U.S. Pat. Nos. 4,029,927 to McMillan; 4,114,011 to Stubbs; 4,152,567 to Mayfield and 4,284,869 to Pinkstaff all are illustrative of such prior art. While these units may be suitable for the particular purpose to which they address, they would not be as suitable for the purposes of the present invention as heretofore described.

SUMMARY OF THE INVENTION

A primary object of the present invention is to provide a microwave heat pipe heating system that will overcome the shortcomings of the prior art devices.

Another object is to provide a microwave heat pipe heating system that would heat a domestic water supply indirectly by a sealed heat pipe with self-contained water between a domestic hot water tank and a microwave containment enclosure.

An additional object is to provide a microwave heat pipe heating system in which a microwave permeable pipe inside a microwave containing enclosure is divided into smaller pipes upon entering and reconvening before exiting to expose more water surface area to a microwave beam for more heating efficiency.

A further object is to provide a microwave heat pipe heating system that is simple and easy to use.

A still further object is to provide a microwave heat pipe heating system that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

The figures are briefly described as follows:

FIG. 2 is a diagrammatic flow diagram of a heating system using an alternate embodiment of the invention.

FIG. 3 is a cross sectional view of the alternate embodiment in FIG. 2, showing the microwave permeable pipe divided into smaller pipes within the microwave containment enclosure.

FIG. 4 is an enlarged cross sectional view taken along line 4—4 in FIG. 3, showing water to be heated within one of the smaller pipes.

DETAILED DESCRIPTION OF THE PREFERRED EMBODIMENTS

Figure 1:
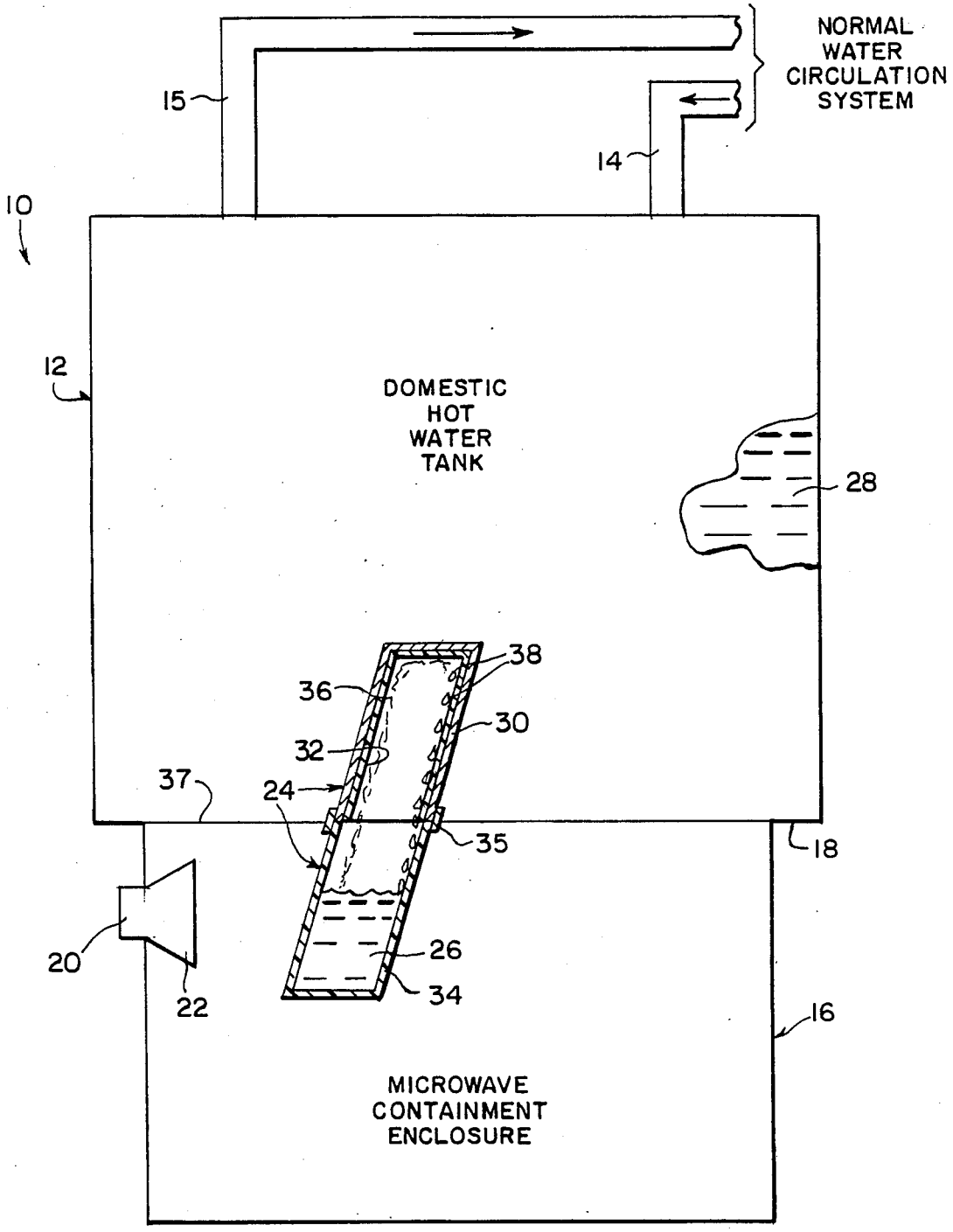
FIG. 1 is a diagrammatic cross sectional view of the invention.

Turning now descriptively to the drawings, in which similar reference characters denote similar elements throughout the several views, FIG. 1 illustrates a microwave heat pipe heating system 10 consisting of a domestic hot water tank 12 having a cold water inlet pipe 14 and a hot water outlet pipe 15 connected to a normal water circulation system (not shown). A microwave containment enclosure 16 is mounted to the underside of a bottom wall 18 of the domestic hot water tank 12. A microwave generator 20 has a wave guide 22 for directing microwave beams into the microwave containment enclosure 16. At least one sealed heat pipe 24 is provided having self contained water 26 therein. The heat pipe 24 extends from the microwave containment enclosure 16 into the domestic hot water tank 12 so that the self contained water 26 heated by the microwave beams will cause the sealed heat pipe 24 extending into the domestic hot water tank 12 to heat water 28 therein for use in the normal water circulation system.

The sealed heat pipe 24 contains a top portion 30 fabricated out of a heat conductive metal that will extend through the bottom wall 18 of the domestic hot water tank 12. A protective coating 32 is applied onto the interior surface of the top portion 30 to prevent microwave damage. A bottom portion 34 is fabricated out of microwave permeable material that will extend through the top wall 37 of the microwave containment enclosure 16. A connector 35 is for sealing the top portion 30 to the bottom portion 34 to keep the self contained water 26 therein.

The sealed heat pipe 24 is slightly slanted from a vertical position between the domestic hot water tank 12 and the microwave containment enclosure 16. When the self contained water 26 inside the sealed heat pipe 24 is boiled to steam 36 inside the bottom portion 34, it will convert to the top portion 30 to heat the water 28 in the domestic hot water tank 12. The steam 36 will then cool and condense back into water droplets 38 to drip down the slightly slanted sealed heat pipe 24 back into the bottom portion 34 in which the water 26 can be heated again into steam 36.

Am alternate microwave heat pipe heating system 40 is shown in FIG. 3 and contains a microwave generator 42 having a wave guide 44 for directing microwave beams. A microwave heat insulation containment enclosure 46 has microwave reflecting walls 48 for containing the microwave beams generated by the microwave generator 42. A microwave permeable pipe 50 extends through two opposite walls 48 of the microwave containment enclosure 46 for convening water 52 capable of being heated by the microwave beams. The pipe 50 is divided into smaller pipes 54 after entering through one of the walls 48 and reconvening before exiting through other of the walls 48 of the microwave containment enclosure 46 to expose more water surface areas to the microwave beams to enhance the heating efficiency of the enclosure beams reflected off of the reflecting walls 48 of the microwave containment enclosure 46. FIG. 4 shows one of the smaller pipes 54 with the water 52 therein.

FIG. 2 shows a flow diagram of a typical heating system 56 using the alternate heat pipe heating system 40 shown in FIG. 3. The alternate heat pipe heating system 40 is fluidly connected between a thermal storage tank 58 and a main circulating pump 60 and is controlled by sensors 62 and 64 and a microwave differential thermostat 66. A heating unit 68 is also fluidly connected to the thermal storage tank 58. A pump 69 is fluidly connected between a domestic hot water tank 70 and the thermal storage tank 58 and is controlled by sensors 72 and 74 and hot water differential thermostat 76.

LIST OF REFERENCE NUMBERS

10—microwave heat pipe heating system
12—domestic hot water tank
14—cold water inlet pipe
15—hot water outlet pipe
16—microwave containment enclosure
18—bottom wall of 12
20—microwave generator
22—wave guide
24—sealed heat pipe
26—self contained water in 24
28—water in 12
30—top portion of 24
32—protective coating
34—bottom portion of 24
35—connector
36—steam
37—top wall of 16
38—water droplets
40—alternate microwave heat pipe heating system
42—microwave generator
44—wave guide
46—microwave heat insulation containment enclosure
48—microwave reflecting wall
50—microwave permeable pipe
52—water
54—smaller pipe of 50
56—typical heating system
58—thermal storage tank
60—main circulating pump
62—sensor
64—sensor
66—microwave differential thermostat
68—heating unit
69—pump
70—domestic hot water tank
72—sensor
74—sensor
76—hot water differentail thermostat It will be understood that each of the elements described above, or two or more together, may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed in new and desired to be protected by Letters Patent is set forth in the appended claims:

1. A microwave heat pipe heating system which comprises:

(a) a domestic hot water tank having a cold water inlet pipe and a hot water outlet pipe connected to a normal water circulation system;

(b) a microwave containment enclosure mounted to the underside of a bottom wall of said domestic hot water tank;

(c) a microwave generator having a wave guide for directing microwave beams into said microwave containment enclosure; and (d) at least one sealed heat pipe having self contained water therein, said at least one sealed heat pipe extending from said microwave containment enclosure into said domestic hot water tank so that the self contained water heated by the microwave beams will cause said at least one sealed heat pipe extending into said domestic hot water tank to heat water therein for the use in the normal water circulation system; wherein each of said at least one sealed heat pipe comprises a top portion made of a heat conductive metal extending through said bottom wall of said domestic hot water tank; a protective coating applied onto the interior surface of said top portion to prevent microwave damage; a bottom portion made of microwave permeable material extending through the top wall of said microwave containment enclosure; and a connector sealing said top portion to said bottom portion to keep the self contained water therein.

2. A microwave heat pipe heating system as recited in claim 1, wherein said at least one sealed heat pipe is slightly slanted from a vertical position between said domestic hot water tank and said microwave containment enclosure, so that when the self contained water inside said sealed heat pipe is boiled to steam inside said bottom portion, it will convect to said top portion to heat the water in said domestic hot water tank, then cool and condense back into water droplets to drip down said at least one slightly slanted sealed heat pipe back into said bottom portion in which the water can be heated again into steam.

* * * * *